US008772662B2

(12) United States Patent
Nishikawa et al.

(10) Patent No.: US 8,772,662 B2
(45) Date of Patent: Jul. 8, 2014

(54) ROTARY SWITCH

(71) Applicant: Panasonic Corporation, Osaka (JP)

(72) Inventors: Hisashi Nishikawa, Shiga (JP); Minoru Shiozaki, Fukui (JP)

(73) Assignee: Panasonic Corporation, Osaka (JP)

( * ) Notice: Subject to any disclaimer, the term of this patent is extended or adjusted under 35 U.S.C. 154(b) by 149 days.

(21) Appl. No.: 13/644,830

(22) Filed: Oct. 4, 2012

(65) Prior Publication Data

US 2013/0092519 A1 Apr. 18, 2013

(30) Foreign Application Priority Data

Oct. 18, 2011 (JP) ..... 2011-228586

(51) Int. Cl.

| | |
|---|---|
| ***H01H 13/62*** | (2006.01) |
| ***H01H 19/58*** | (2006.01) |
| ***H01H 19/11*** | (2006.01) |
| *H01H 19/02* | (2006.01) |

(52) U.S. Cl.

CPC ..... *H01H 19/11* (2013.01); *H01H 19/025* (2013.01); *H01H 19/585* (2013.01)

USPC ..... 200/565

(58) Field of Classification Search

CPC ..... H01H 19/11; H01H 19/025; H01H 19/02

USPC ..... 200/565, 564, 316, 11 R

See application file for complete search history.

(56) References Cited

U.S. PATENT DOCUMENTS

| | | | | |
|---|---|---|---|---|
| 4,227,058 | A * | 10/1980 | Johnston et al. | 200/566 |
| 5,008,498 | A * | 4/1991 | Yamazaki | 200/11 R |
| 6,894,242 | B2 * | 5/2005 | Muller et al. | 200/568 |
| 7,057,127 | B1 * | 6/2006 | Kuan | 200/334 |
| 7,476,822 | B2 * | 1/2009 | Miura et al. | 200/564 |
| 2005/0241925 | A1 | 11/2005 | Altmann et al. | |

FOREIGN PATENT DOCUMENTS

JP 2005-317538 11/2005

* cited by examiner

*Primary Examiner* — Kyung Lee

(74) *Attorney, Agent, or Firm* — Panasonic Patent Center

(57) ABSTRACT

In a rotary switch, a latching portion having a recess or a hole provided in a decorative cover engages with a locking portion having a protrusion provided on an operating knob, and a catching portion of a rotary body contacts with an inner side of the locking portion on one side closer to the rotary body. The decorative cover is thus attached to the operating body.

7 Claims, 9 Drawing Sheets

ROTARY SWITCH

BACKGROUND

1. Technical Field

The technical field relates to rotary switches used mainly for operating various electronic apparatuses inside cabins of motor vehicles.

2. Background Art

In recent years, the number of rotary switches mounted to front panels and areas in the proximity of steering wheels in motor vehicles has increased. Such switches permit users to perform various controls of the vehicles, and operate various electronic apparatuses inside the vehicles. Referring to FIG. 7 to FIG. 9, description is provided of one such type of conventional rotary switches. FIG. 7 is a cross-sectional view of a conventional rotary switch, and FIG. 8 is an exploded perspective view of the rotary switch. FIG. 9 is a perspective view of the rotary switch.

Operating body 1 has operating knob 1A formed into generally a rectangular parallelepiped shape on the upper side, and cylinder portion 1B of generally a cylindrical shape on the lower side thereof. Decorative cover 2 has generally a U-shape in the top view, and is metal-plated to provide a silver finish, for instance, on the surface. Decorative cover 2 is bonded to the outer periphery of operating knob 1A with an adhesive or the like material.

Rotary body 3 has upper cylinder portion 3A of generally a cylindrical shape on the upper part, and shaft portion 3B of generally a cylindrical shape extending downward from the lower surface at the center thereof. Upper cylinder portion 3A is placed inside cylinder portion 1B of operating body 1. Upper cylinder portion 3A includes projections provided around an outer periphery thereof to engage individually with holes in a side surface of cylinder portion 1B. Rotary body 3 is attached to operating body 1 in a manner as described above.

Case 4 of generally a box-like shape has hollow tube-shaped support portion 4A formed in the substantial center thereof. Support portion 4A includes shaft portion 3B of rotary body 3 inserted therein so that rotary body 3 is rotatably supported inside case 4.

Pin 5 and coil spring 6 are placed in a predetermined position inside case 4. The tip end of pin 5 being thrust upward by coil spring 6 contacts elastically with cam portion 3C having a series of projections and depressions formed on generally same radius on the lower surface of rotary body 3. These components compose a tactile-click producing unit. This tactile-click producing unit allows rotary body 3 to be rotatable relative to case 4 while producing tactile responses, and also holds rotary body 3 at any given position of the rotation.

Wiring board 7 has conductive patterns and the like formed on both upper and lower surfaces. Light-emitting elements such as light-emitting diodes ("LED") and the like components are mounted on the upper surface, and fixed contacts (not shown) are formed on the lower surface. Wiring board 7 is fixed to the lower surface of case 4.

Contact piece 9 made of an elastic metal plate is fixed to an upper surface of movable body 8, which is then fixed to rotary body 3 near the bottom end of shaft portion 3B that penetrates through support portion 4A. A contact portion of contact piece 9 is in contact elastically with one of the fixed contacts on the lower surface of wiring board 7. Switching unit is thus composed.

Shaft hole 10A in the substantial center of bottom cover 10 covers the bottom side of case 4. Rotary body 3 is clamped with retaining ring 11 fitted into groove 3D in the lower end of shaft portion 3B that penetrates through shaft hole 10A, thereby preventing shaft portion 3B from coming off upward.

Top cover 12 covers an opening of case 4 around operating body 1, and it is fixed securely to case 4. Rotary switch 20 shown in FIG. 9 is constructed as discussed above.

When assembling rotary switch 20, the first step is to apply an adhesive to operating knob 1A, place decorative cover 2 thereon, and harden the adhesive to complete bonding of decorative cover 2 to operating body 1.

Next, rotary body 3 is attached to the underside of operating body 1, and shaft portion 3B is inserted in support portion 4A of case 4 in which pin 5 and coil spring 6 are set in their positions. Thereafter, top cover 12 is placed on case 4, and is fixed to case 4 with operating knob 1A of operating body 1 protruding above top cover 12.

Furthermore, shaft portion 3B is inserted into hole 7A at the center substantial of wiring board 7, and wiring board 7 is placed to the underside of case 4. After that, shaft portion 3B is inserted into hole 8A of movable body 8 provided with contact piece 9 so that the contact portion of contact piece 9 comes into elastic contact with any of the fixed contacts on the lower surface of wiring board 7.

Then, shaft portion 3B is inserted into hole 10A of bottom cover 10, bottom cover 10 is placed under movable body 8, and bottom cover 10 and wiring board 7 are fixed to case 4 with a plurality of screws (not shown). Finally, retaining ring 11 is fixed by being clamped in groove 3D in the lower end of shaft portion 3B, thus completing assembly of rotary switch 20.

Rotary switch 20 is mounted to a front panel or an area in the proximity of a steering wheel in a motor vehicle. The switching unit is electrically connected to an electronic circuit (not shown) in the motor vehicle via the conductive patterns on wiring board 7, connectors, lead wires and the like (not shown).

In the structure described above, when operating knob 1A is turned clockwise from the position shown in FIG. 9, operating body 1 rotates with tactile responses produced by the tactile-click producing unit until operating body 1 is held at a predetermined position of the rotation. This causes the switching unit to make and break electrical continuity by moving of shaft portion 3B of rotary body 3 and movable body 8 mounted to shaft portion 3B. The electronic circuit of the motor vehicle controls various apparatuses mounted to the vehicle according to making and breaking of the electric continuity of the switching unit. For example, selection of lights and various modes of turning on and off of the lights can be switched selectively, such as the so-called automatic lighting for turning the light on and off automatically, turning a taillight on and off, and turning a headlight on and off.

SUMMARY

A rotary switch of according to various embodiments has an operating body, a decorative cover, a rotary body and switching unit. The operating body has a hollow operating knob, a hollow cylinder portion and a locking portion. The cylinder portion is connected to the operating knob, and opened at one end opposite to the operating knob. The locking portion is provided so that it extends from a side surface of operating knob toward the cylinder portion. The locking portion is elastically deformable in an inside-to-outside direction of the operating knob because of a space provided between the tip end and the cylinder portion. The decorative cover has a cover portion and a latching portion extending toward the operating body from a surface of the cover portion confronting the cylinder portion of the operating body. The rotary body has a catching portion contacting with the locking portion, and it is disposed inside the cylinder portion of the operating body. The switching unit makes and breaks electrical continuity when the rotary body is rotated by rotational operation of the operating body. One of the latching portion and the locking portion is provided with a recess, and the other one is provided with a protrusion. The decorative cover is attached to the operating knob by an engagement the recess and the protrusion, and the contact between the catching portion and the locking portion.

DETAIL DESCRIPTION OF PREFERRED EMBODIMENTS

Figure 7:
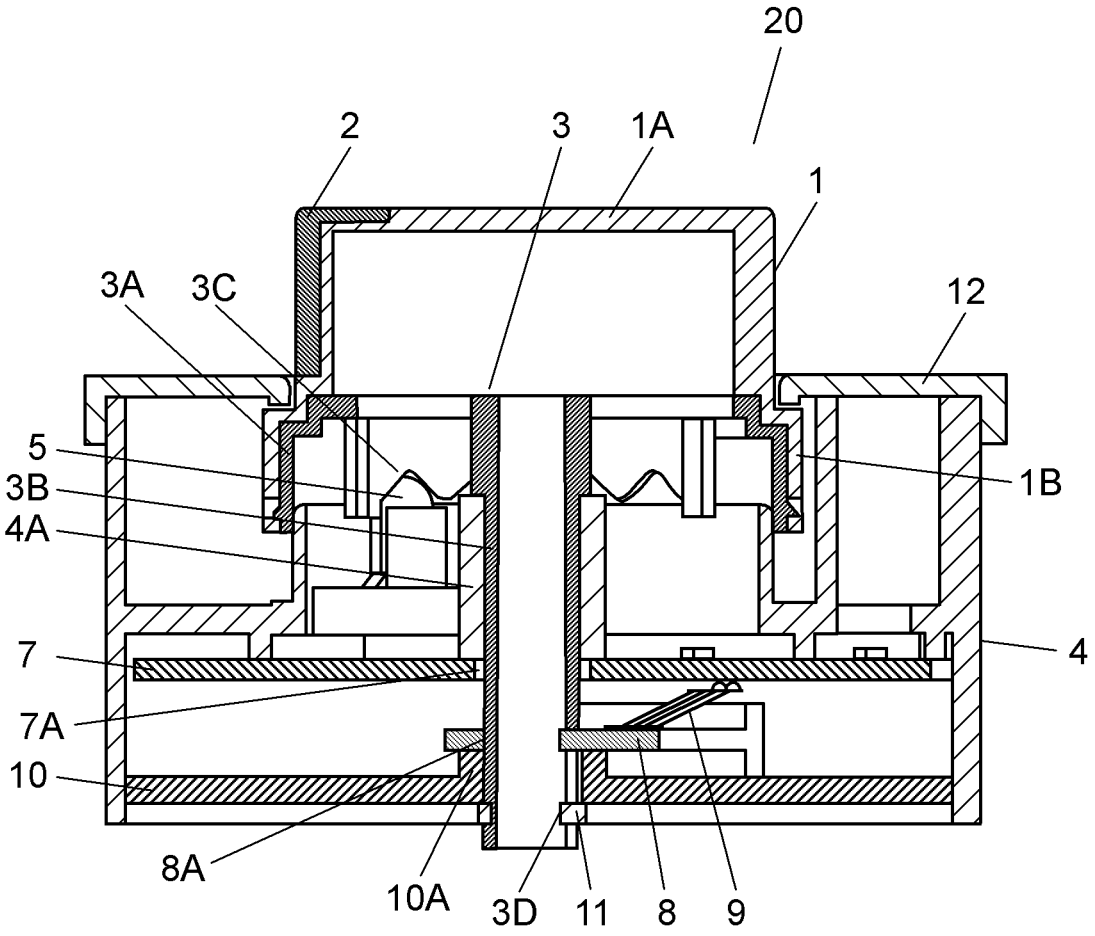
FIG. 7 PRIOR ART
FIG. 7 is a cross-sectional view of a conventional rotary switch.
Figure 8:
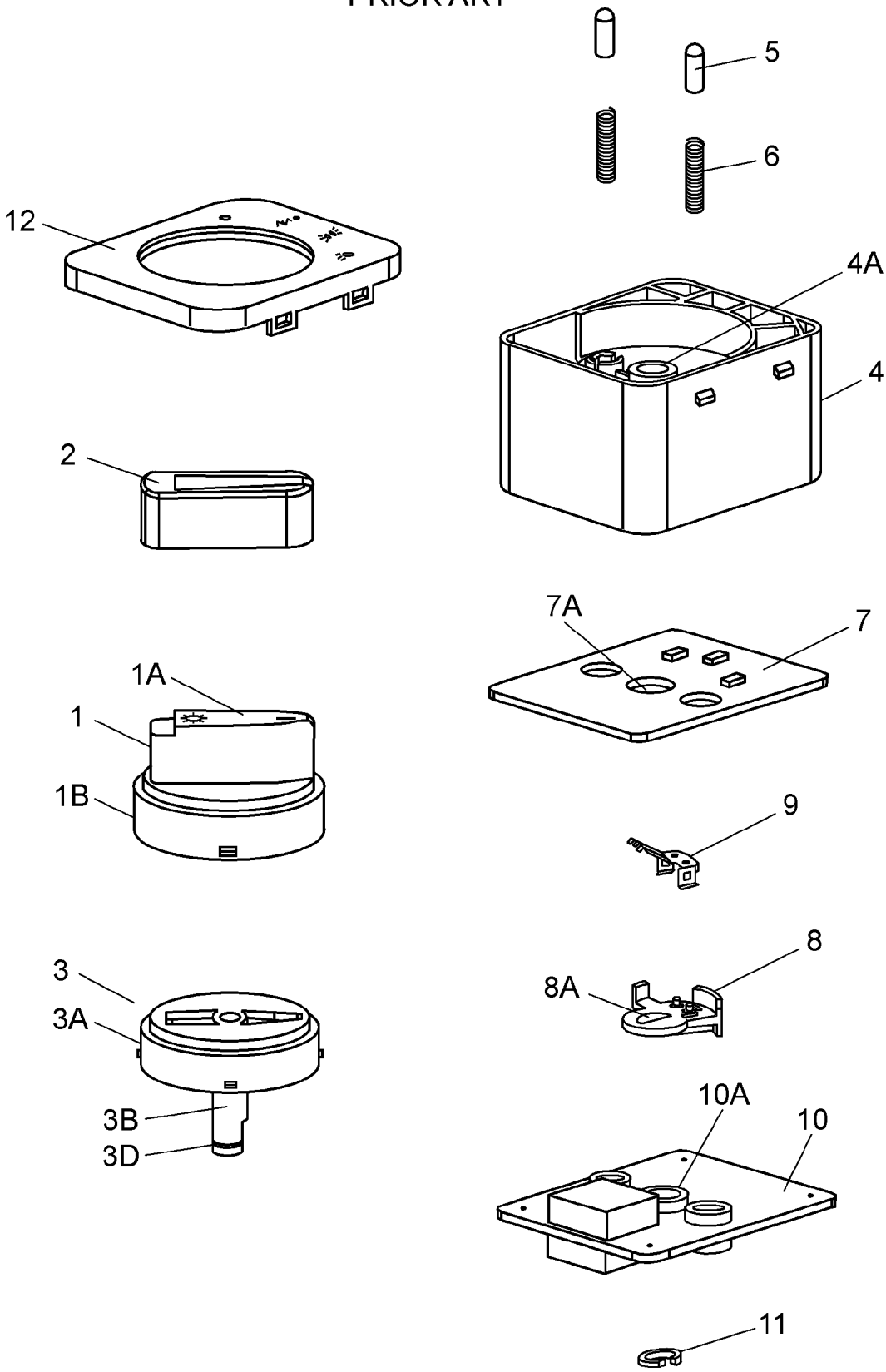
FIG. 8 PRIOR ART
FIG. 8 is an exploded perspective view of the rotary switch shown in FIG. 7.
Figure 9:
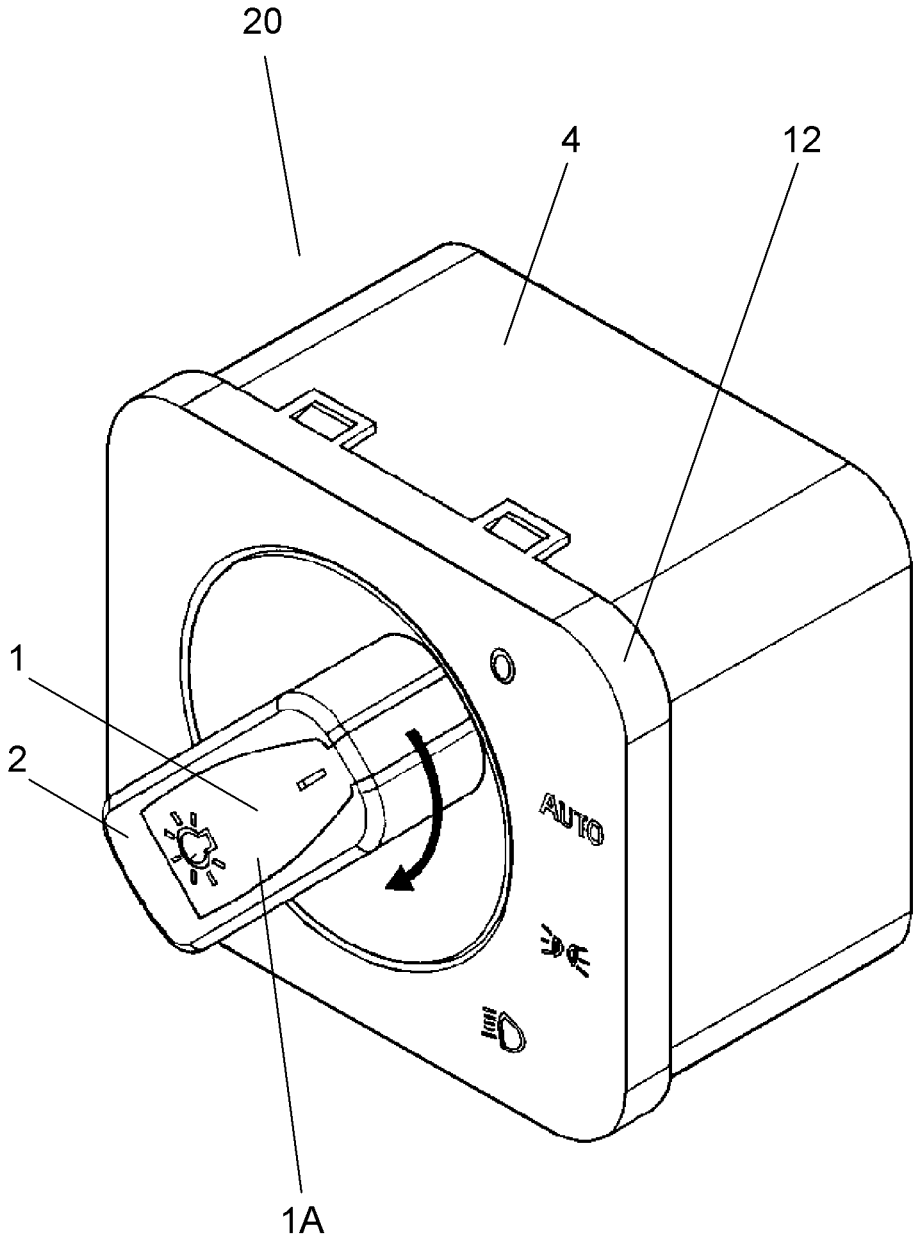
FIG. 9 PRIOR ART
FIG. 9 is a perspective view of the rotary switch shown in FIG. 7.

Description is provided first of some problems associated with the conventional structure shown in FIG. 7 to FIG. 9 before the detailed discussion of exemplary embodiments.

In rotary switch 20, an adhesive is applied to operating knob 1A of operating body 1 when bonding decorative cover 2 to operating knob 1A. This process is time-consuming because of the complexity of bonding decorative cover 2 to operating knob 1A, thereby increasing the production cost. In addition, shaft portion 3B of rotary body 3 is secured by clamping retaining ring 11 after shaft portion 3B is inserted into movable body 8 and bottom cover 10 in which wiring board 7 and contact piece 9 are mounted. This also causes an increase in the production cost since it requires an additional number of components and the clamping process.

Referring now to FIG. 1 to FIG. 6, description will be provided of exemplary embodiments of a rotary switch.

Exemplary Embodiments

Figure 1:
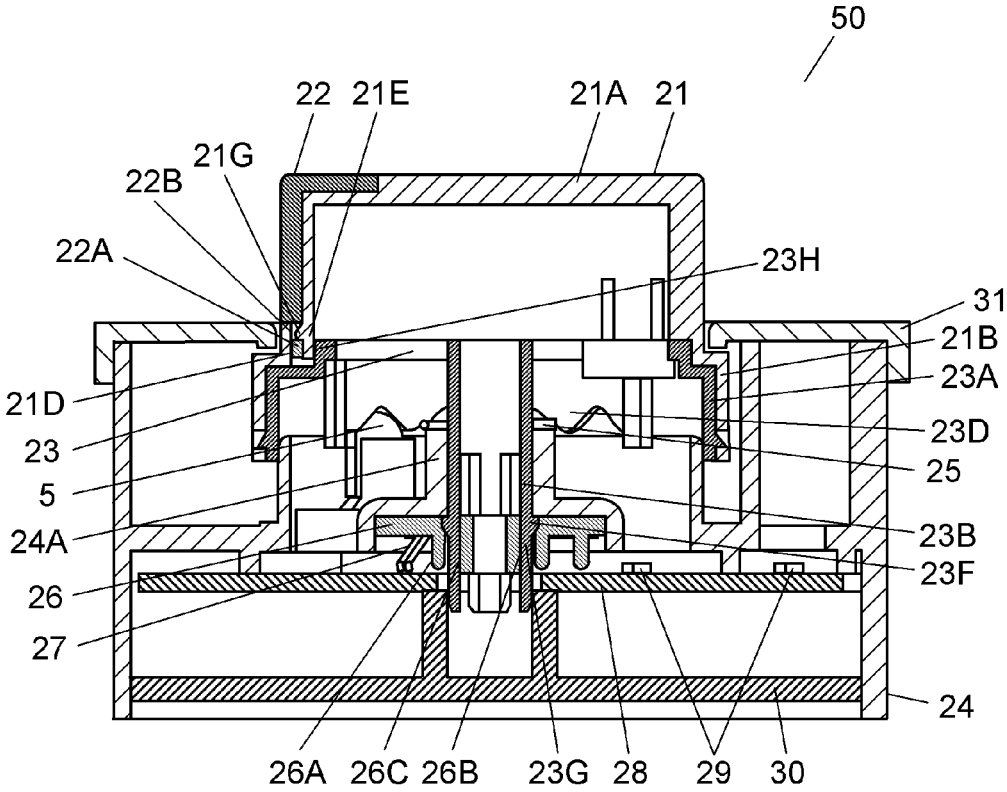
FIG. 1 is a cross-sectional view of a rotary switch according to an exemplary embodiment.
Figure 2:
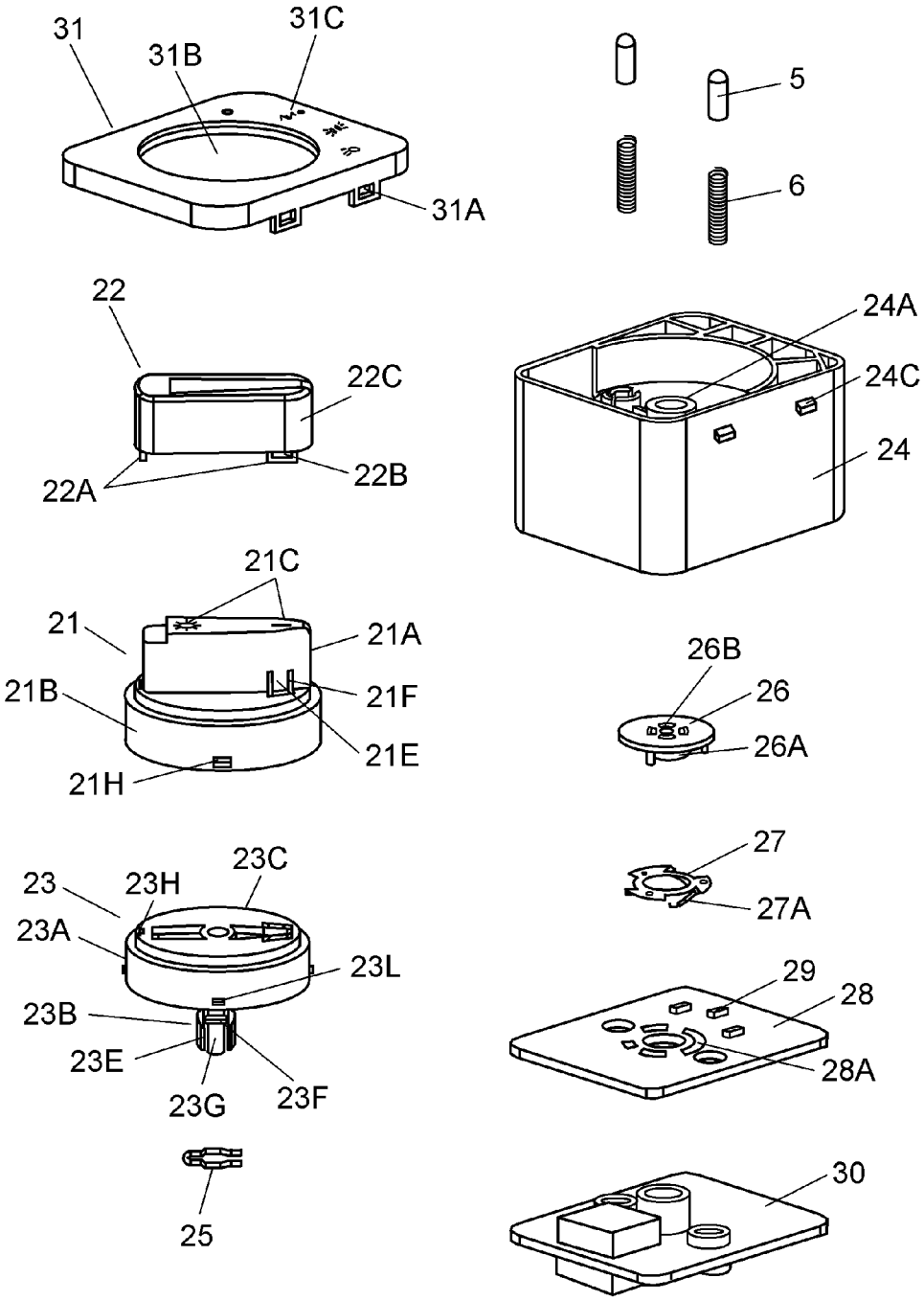
FIG. 2 is an exploded perspective view of the rotary switch shown in FIG. 1.
Figure 3:
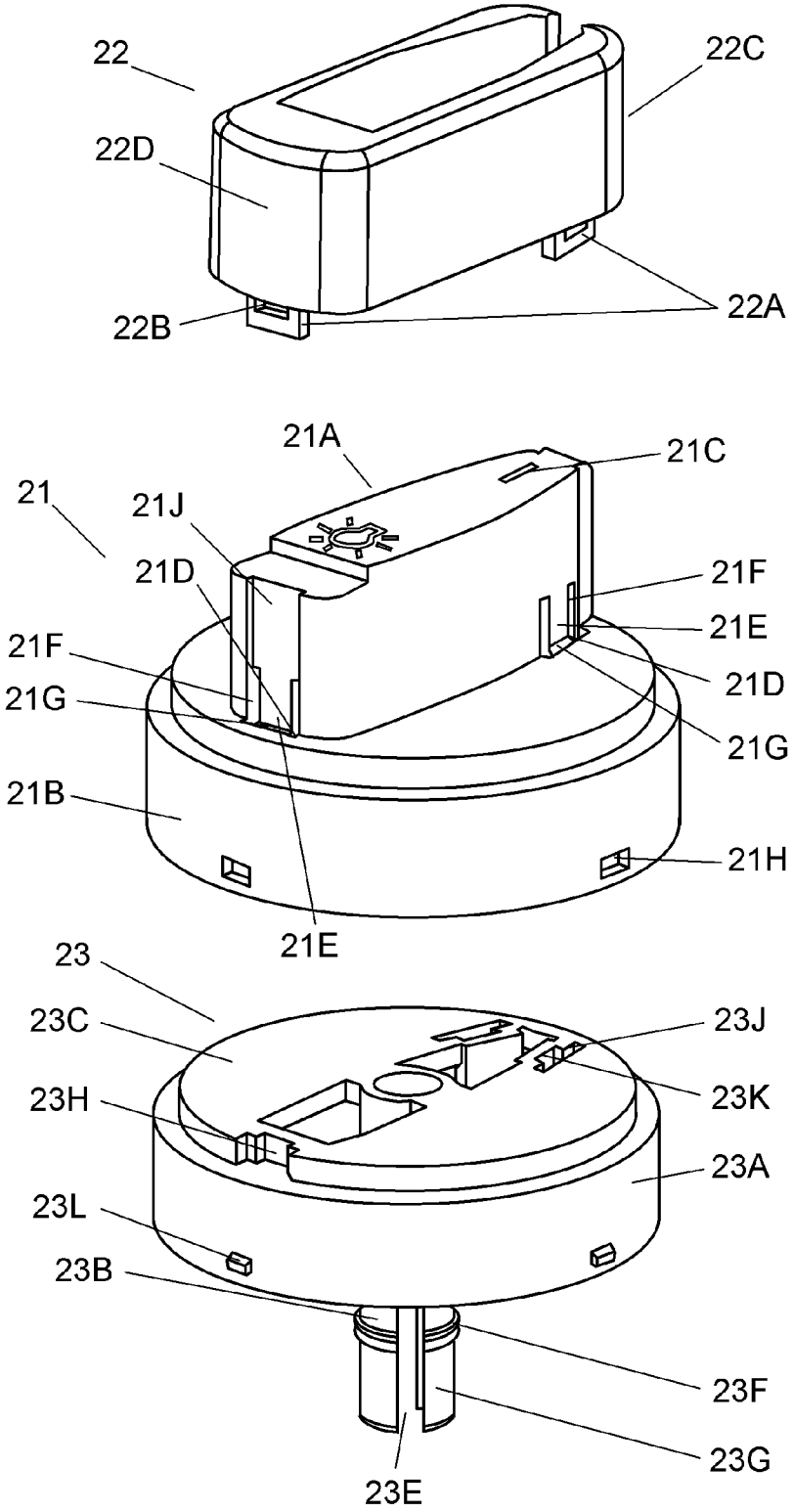
FIG. 3 is an enlarged exploded perspective view of an essential part of the rotary switch shown in FIG. 1.
Figure 4:
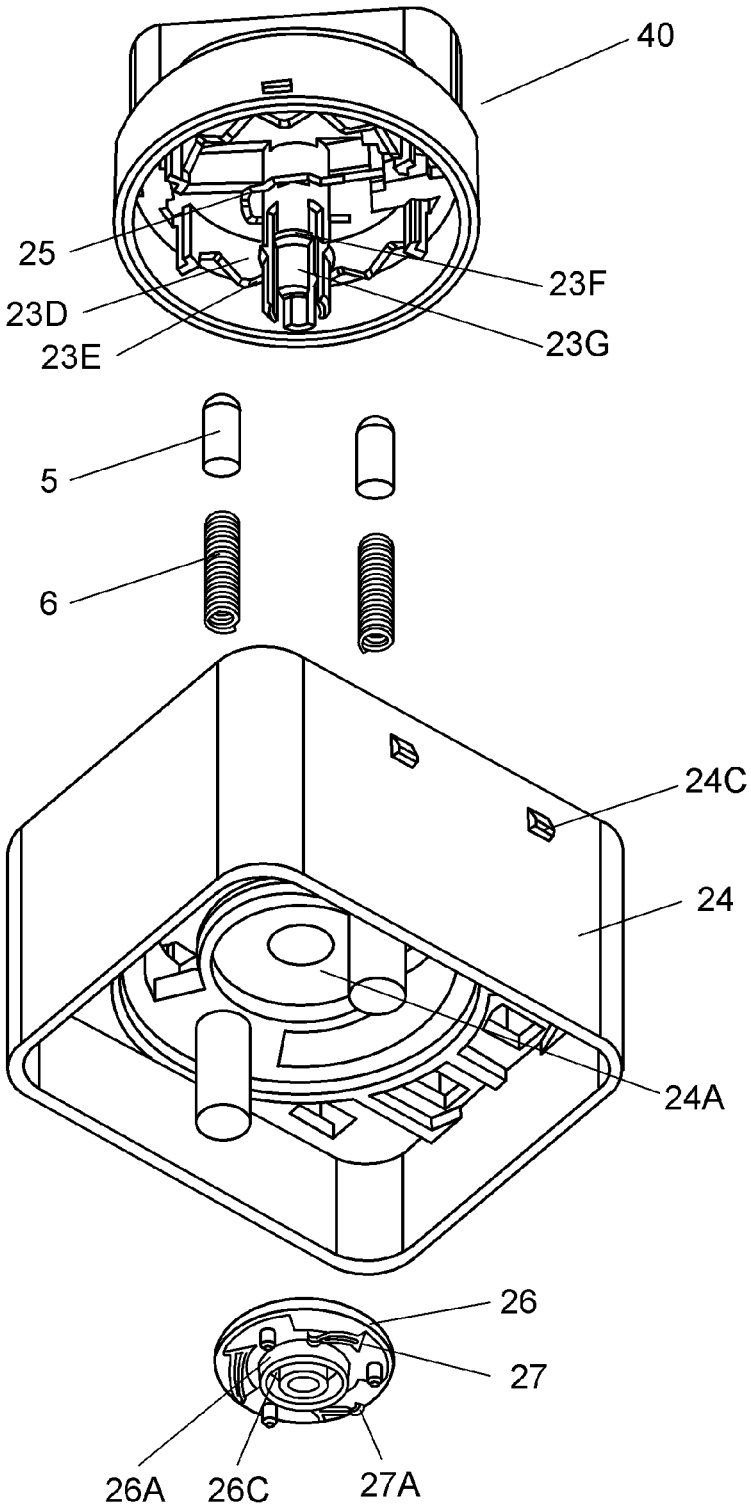
FIG. 4 is another enlarged exploded perspective view of an essential part of the rotary switch shown in FIG. 1.

FIG. 1 is a cross-sectional view of rotary switch 50 according to an exemplary embodiment, and FIG. 2 is an exploded perspective view of rotary switch 50. FIG. 3 and FIG. 4 are enlarged exploded perspective views of essential parts of rotary switch 50.

Rotary switch 50 has case 24, operating body 21, decorative cover 22, rotary body 23, movable body 26, contact piece 27, wiring board 28, top cover 31 and bottom cover 30.

Operating body 21 has hollow cylinder portion 21B, locking portion 21E and hollow operating knob 21A protruding from an opening of case 24. Cylinder portion 21B connected to operating knob 21A is housed inside case 24, and it is opened at one end opposite to operating knob 21A. Locking portion 21E extends from a side surface of operating knob 21A toward cylinder portion 21B while a space is provided between a tip of locking portion 21E and cylinder portion 21B. Locking portion 21E is elastically deformable in an inside-to-outside direction of operating knob 21A with an aid of the space.

Decorative cover 22 has cover portion 22C and latching portion 22A that extends toward operating body 21 from a surface of cover portion 22C confronting cylinder portion 21B of operating body 21. Rotary body 23 has catching portion 23H that contacts with latching portion 22A. Rotary body 23 is disposed in cylinder portion 21B of operating body 21 such that it is retained rotatably within case 24.

Movable body 26 is attached to rotary body 23 at an opposite side to operating body 21. Contact piece 27 is fixed to movable body 26, and has contact portion 27A that extends outward from a surface opposite to the surface fixed to movable body 26. Wiring board 28 has a plurality of fixed contacts 28A that confront contact portion 27A.

The individual components will be described below. Operating body 21 is formed of a translucent insulating resin such as polycarbonate (hereinafter referred to as PC). Operating body 21 has operating knob 21A of generally a rectangular parallelepiped shape at the upper side, and cylinder portion 21B of generally a cylindrical shape at the lower side thereof. The surface of operating body 21 is coated with a nontransparent paint. The paint is removed from certain areas by laser machining or the like process into predetermined shapes such as signs, characters and symbols to form display section 21C on the upper surface of operating knob 21A.

Decorative cover 22 has a generally U-letter shape in the top view, is made of a synthetic resin such as acrylonitrile butadiene-styrene copolymer (hereinafter referred to as ABS), and it is metal-plated to provide a silver finish, for instance, on the surface.

In addition, generally U-shaped decorative cover 22 has latching portions 22A that extend downward from their respective positions located at a curved portion and both side ends on the underside surface slightly inward from the outer periphery, as shown in FIG. 3. Latching portions 22A are generally tongue-shaped, and each has hole 22B in the substantial center thereof.

Operating body 21 is provided with connecting holes 21D formed at the lower part of the side face of operating knob 21A in positions corresponding to latching portions 22A of decorative cover 22, through which latching portions 22A are insertable. Operating body 21 also has locking portions 21E at the inner side of connecting holes 21D. Locking portions 21E are formed to be elastically deformable to inward because of slits 21F provided at their both sides. Each of locking portions 21E is provided with protrusion 21G that protrudes outward on a lower part. Latching portions 22A of decorative cover 22 have a thickness (i.e., a dimension between the inner surface and the outer surface) larger than a thickness of locking portions 21E of operating body 21.

Rotary body 23 is formed of a nontransparent insulating resin such as polyoxymethylene (hereinafter referred to as POM). Rotary body 23 has upper cylinder portion 23A of generally a cylindrical shape at the upper side. Upper face portion 23C of generally a disc-like shape extends upward from the upper surface of upper cylinder portion 23, and shaft portion 23B of generally a cylindrical shape extends downward in the center of the underside surface of upper cylinder portion 23. That is, shaft portion 23B protrudes from upper cylinder portion 23A toward opposite side of operating body 21. As shown in FIG. 4, tactile-click cam 23D is provided such that it has a wall-like shape having a series of projections and depressions formed along a lower edge of same radius around the outside of shaft portion 23B.

As shown in FIG. 3, retaining portions 23G are provided at the bottom end of shaft portion 23B. Retaining portions 23G are formed with slits 23E so that they are inwardly elastically deformable. Retaining portions 23G also include outwardly protruding retaining ledges 23F formed at a predetermined position along the vertical direction thereof. In other words, shaft portion 23B includes retaining ledges 23F provided along the outer periphery at the tip end side, and retaining portions 23G formed closer to the tip end than retaining ledges 23F. Retaining portions 23G are elastically deformable in the radial direction of shaft portion 23B.

Protrusion 21G on locking portion 21E of operating body 21 engages with hole 22B of latching portion 22A located at curved portion 22D of decorative cover 22. In addition, the inner side of locking portion 21E contacts with catching portion 23H, which is a recess formed in the outer rim of upper surface 23C of rotary body 23. Likewise, protrusions 21G on other locking portions 21E engage in their corresponding holes 22B of latching portions 22A located at both sides of decorative cover 22. The surfaces of locking portions 21E confronting rotary body 23 also contact with their corresponding catching portions 23K inside catching recesses 23J that are recesses formed near the outer rim of upper surface 23C of rotary body 23. Note that holes 22B need not be through holes, but they may be recessed holes provided in latching portion 22A so long as they can hold protrusions 21G of locking portions 21E.

Cylinder portion 21B is provided with fixing holes 21H in its outer periphery. On the other hand, rotary body 23 has fixing protrusions 23L formed on the outer periphery of upper cylinder portion 23A. Individual fixing protrusions 23L engage into corresponding fixing holes 21H so that rotary body 23 is attached in place as being housed inside cylinder portion 21B of operating body 21.

Case 24 is made of an insulating resin such as ABS and POM, and has generally a box-like shape with an opening in the vertical direction. As shown in FIG. 4, there is support portion 24A of a hollow tube shape formed in the substantial center of case 24. Shaft portion 23B of rotary body 23 is inserted in support portion 24A so that rotary body 23 is rotatably supported by case 24. In other words, case 24 has support portion 24A rotatably holding shaft portion 23B inserted therethrough.

Restricting part 25 is fitted into a groove (not shown) provided on shaft portion 23B. Restricting part 25 is disposed to a position at the top end of support portion 24A. That is, restricting part 25 is attached to shaft portion 23B of rotary body 23 near one end closer to operating body 21, of support portion 24A of case 24. Restricting part 25 restricts downward movement of rotary body 23. In addition, restricting part 25 is configured to cause operating body 21 to shift downward to alleviate an excessive impact load to operating body 21 when the impact exerted upon operating body 21 exceeds a retentive force of restricting part 25.

Pin 5 and coil spring 6 are disposed in predetermined positions within case 24. The tip end of pin 5 thrust upward by coil spring 6 contacts elastically with cam portion 23C on the lower surface of rotary body 23. They compose a tactile-click producing unit. The tactile-click producing unit allows rotary body 23 to be rotatable relative to case 24 while producing tactile responses, and also holds rotary body 23 at any given position of the rotation.

Movable body 26 is generally a disc-like shape made of an insulating resin such as poly-butylene terephthalate (hereinafter referred to as PBT), and has retaining shaft 26A of generally a cylindrical shape formed on the lower surface. Retaining holes 26B of generally a circular arc shape are formed annularly inside retaining shaft 26A. That is, movable body 26 has retaining holes 26B that hold retaining portions 23G of shaft portion 23B. Movable body 26 is attached to shaft portion 23B by having retaining holes 26B retain retaining portions 23G at an opposite end of support portion 24A to operating body 21.

Retaining ledges 23F on retaining portions 23G of rotary body 23 inserted through support portion 24A come into contact with the lower end of support portion 24A. At the same time, interior sides of retaining portions 23G contact with confronting stopper faces 26C inside retaining holes 26B, so that stopper faces 26C prevent retaining portions 23G from deforming inward. Retaining portions 23G are fixed in place by being retained securely with movable body 26 at the lower end of support portion 24A.

Contact piece 27 of generally a ring shape is made of an elastic metal plate. Contact piece 27 is fixed to the underside of movable body 26, and has contact portion 27A that extends downward.

Wiring board 28 is made of an insulating resin, and has conductive patterns formed on both upper and lower surfaces thereof. Wiring board 28 includes fixed contacts 28A formed at predetermined positions on the upper surface in addition to a variety of electronic components and light-emitting elements 29 such as light-emitting diodes mounted thereon.

Contact portion 27A of contact piece 27 is in elastic contact with confronting one of fixed contacts 28A, and makes and breaks an electrical continuity between contact piece 27 and fixed contacts 28A with rotation of movable body 26. As described, the switching unit is so constructed as to make and break the electrical continuity when rotary body 23 is rotated by rotating operation of operating body 21. In other words, the switching unit includes movable body 26, contact piece 27 and wiring board 28.

Bottom cover 30 is made of an insulating resin such as PBT, and is fixed to case 24 with a screw or the like (not shown) to cover an opening in the underside of case 24. Top cover 31 made of an insulating resin such as PC is fastened to case 24. Rotary switch 50 is constructed in the manner as discussed above.

Description is provided next of how rotary switch 50 is assembled. First, decorative cover 22 is placed on operating knob 21A of operating body 21 from above, as shown in FIG. 3, and each of latching portions 22A is forced to slip into corresponding one of connecting holes 21D. During this step, locking portions 21E deform elastically inward as latching portions 22A move downward along locking portions 21E, and protrusions 21G on locking portions 21E come to engage with holes 22B in latching portions 22A.

Latching portions 22A have a thickness larger than that of locking portions 21E. Therefore, latching portions 22A don't deform while locking portions 21E deform elastically inward when latching portions 22A move downward along locking portions 21E. This structure can prevent a crack and stress which may causes exfoliation of the plated metal from decorative cover 22.

It is also desirable to form guide channel 21J by grooving the upper side (i.e., opposite side of cylinder portion 21B) of locking portion 21E, as shown in FIG. 3. In this case, latching portion 22A slides downward while being guided along guide channel 21J, and consequently engages with locking portion 21E.

Next, when rotary body 23 is inserted into cylinder portion 21B of operating body 21 from the lower side, fixing protrusions 23L of rotary body 23 engage in fixing holes 21H so that rotary body 23 is fixed to operating body 21.

At the same time, catching portion 23H as well as catching portions 23K at catching recesses 23J confronting in a front-to-back direction of rotary body 23 contact with inner sides of their corresponding locking portions 21E of operating body 21. Catching portions 23H and 23K restrict and prevent respective locking portions 21E from being deformed inward, and decorative cover 22 is hence attached and fixed securely to operating body 21.

Catching portion 23H and catching recesses 23J that contact with and retain the respective locking portions 21E of operating body 21 are not bored downward. In addition, the material of rotary body 23 is preferably a nontransparent insulating resin. It can hence prevent light from light-emitting elements 29 disposed on wiring board 28 from leaking outside through slits 21F and the vicinity thereof on both sides of locking portions 21E via catching portion 23H and catching recesses 23J, as will be described later.

In addition, restricting part 25 is fitted into a groove (not shown) in a predetermined upper position of shaft portion 23B of rotary body 23. The above processes complete operational assembly unit 40 made of decorative cover 22, operating body 21, rotary body 23 and restricting part 25 connected together, as shown in FIG. 4.

After pin 5 and spring 6 are inserted in their respective positions in the upper surface of case 24, shaft portion 23B of rotary body 23 projecting downward from operational assembly unit 40 is inserted into support portion 24A from above case 24. During this step, retaining portions 23G of shaft portion 23B slide through support portion 24A while being deformed elastically inward, and they are held in position when retaining ledges 23F are caught on the lower end of support portion 24A.

Top cover 31 is then placed on case 24 to make fixing protrusions 24C on side surfaces of case 24 engage with fixing holes 31A around the lower edges on the sides of top cover 31. The above processes complete an operation unit provided with operating knob 21A of operating body 21 protruding from opening 31B.

Furthermore, retaining portions 23G projecting from the underside of case 24 are inserted in retaining holes 26B of movable body 26 with contact piece 27 fixed to the underside of movable body 26, and movable body 26 is set in shaft portion 23B. This process makes the interior sides of retaining portions 23G contact with stopper faces 26C on the rotational center side of retaining holes 26B. Stopper faces 26C prevent retaining portions 23G from deforming inward. Retaining portions 23G are also held securely with movable body 26 at the lower end of support portion 24A.

Next, wiring board 28 and bottom cover 30 are disposed inside the underside of case 24 and fixed to case 24 with screws or the like. Rotary switch 50 shown in the perspective view of FIG. 6 is assembled by the processes described above.

Rotary switch 50 is mounted to a front panel or an area in the proximity of a steering wheel in a motor vehicle, and the switching unit is connected to an electronic circuit (not shown) in the vehicle via the conductive patterns on wiring board 28, and connectors, lead wires and the like (not shown).

Figure 6:
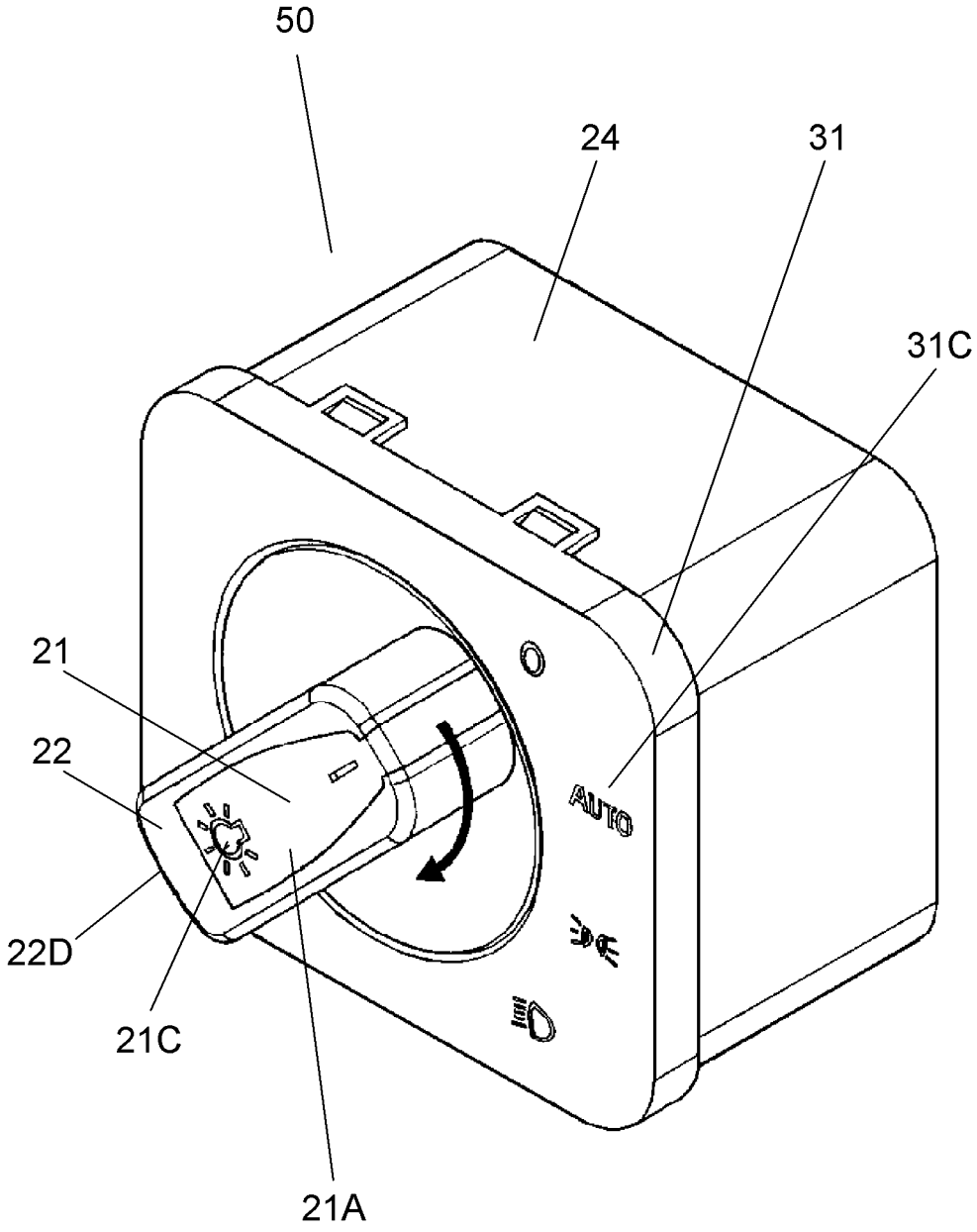
FIG. 6 is a perspective view of the rotary switch according to the exemplary embodiment.

In the structure described above, assume that a user turns operating knob 21A clockwise, for instance, from the state as shown in FIG. 6 in which one end (i.e., an opposite side of curved portion 22D) of operating knob 21A points the OFF position. In this case, operating body 21 and rotary body 23 rotates clockwise around shaft portion 23B with tactile responses produced by the tactile-click producing unit. Operating knob 21A is then held at the "AUTO" position.

Contact piece 27 of movable body 26 mounted to shaft portion 23B makes and breaks electrical contact with fixed contacts 28A, and this electric signal is transmitted to the electronic circuit in the motor vehicle. The electronic circuit in the vehicle makes selective operation responsive to this electric signal, such as the so-called automatic lighting for turning a light on or off automatically according to ambient brightness, for example.

When the user turns operating knob 21A further in the clockwise direction, operating body 21 is held at a predetermined rotational position, and electrical continuity of the switching unit is made and broken according to the rotational position. Accordingly, the switching is made selectively among various modes of lighting such as turning a taillight on and off, and turning a headlight on and off.

In addition, the electronic circuit in the vehicle makes light-emitting elements 29 emit light to illuminate display section 21C of operating knob 21A and display section 31C of top cover 31 when the surroundings become dark in the nighttime or inside a tunnel. The user is hence able to see display sections 21C and 31C easily, and operate operating knob 21A without difficulty.

As described, rotary switch 50 is provided with latching portions 22A that have holes 22B and extend downward from the lower edge of decorative cover 22. Locking portions 21E having elastic protrusions 21G and extending downward are provided on the side surfaces of operating knob 21A of operating body 21. Locking portions 21E engage with latching portions 22A. The inner sides of locking portions 21E on the rotary body side contact with catching portions 23H and 23K in upper surface 23C of rotary body 23. Each of locking portions 21E is thus fixed securely by being held between latching portion 22A from the outside and catching portion 23H or 23K from the inside.

According to the above structure, complex production steps such as using an adhesive when attaching decorative cover 22 to operating body 21 become unnecessary. That is, decorative cover 22 can be attached to operating body 21 easily and secured reliably. As a result, the production cost can be reduced.

The above description discusses an example in which hole 22B is provided in each of latching portions 22A of decorative cover 22, and protrusion 21G is provided on each of locking portions 21E of operating body 21. However, in an alternative embodiment an internally projecting protrusion can be provided on latching portion 22A and a recess provided in locking portion 21E so that they are engaged with each other. In other words, the structure can be such that a recess is provided in one of latching portion 22A and locking portion 21E, and a protrusion is provided on the other of the two, and the recess and the protrusion are engaged with each other. In addition, catching portions 23H contact with locking portions 21E. Decorative cover 22 can be attached to operating knob 21A with this structure.

Rotary body 23 has shaft portion 23B that protrudes downward from the underside surface in the substantial center of upper cylinder portion 23A. Shaft portion 23B includes retaining ledges 23F formed along the outer periphery near the tip end of shaft portion 23B and elastically deformable retaining portions 23G extending from shaft portion 23B. Case 24 has support portion 24A of a hollow tube shape in the bottom surface, so that shaft portion 23B is inserted rotatably in support portion 24A. In addition, retaining ledges 23F of retaining portions 23G are held at the lower end of support portion 24A to prevent shaft portion 23B from slipping off upward.

Furthermore, movable body 26 is provided with retaining holes 26B for holding retaining portions 23G. As movable body 26 is attached to shaft portion 23B, retaining portions 23G are securely fixed to movable body 26 by retaining holes 26B without deforming elastically inward.

Rotary switch 50 described in the above embodiments does not require complicated operations such as clamping a retaining ring to fix the rotary body to the shaft portion as in the conventional rotary switch for assembly. Therefore, the rotary switch can be assembled simpler, at a lower cost and with a less number of components and simple to assemble.

Figure 5:
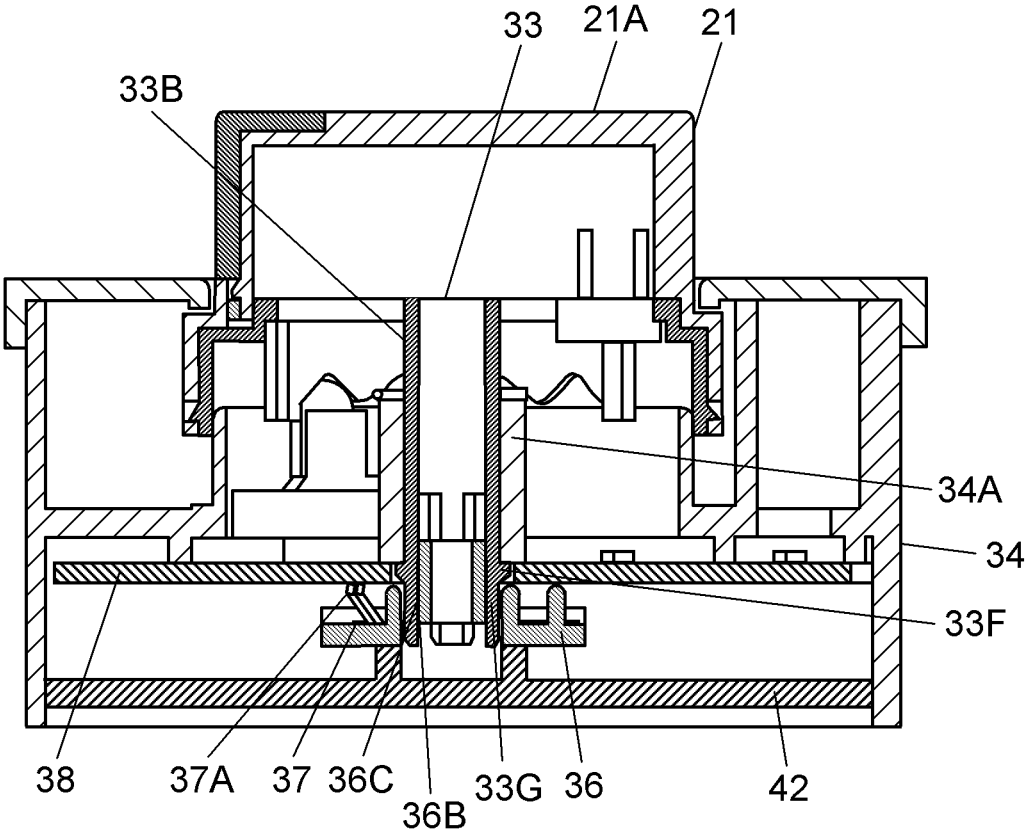
FIG. 5 is a cross-sectional view of another rotary switch according to the exemplary embodiment.

Description is provided next of another rotary switch according to an embodiment with reference to FIG. 5. FIG. 5 is a cross-sectional view of the rotary switch according to this embodiment.

In the structure shown from FIG. 1 to FIG. 4, movable body 26 is disposed between support portion 24A and wiring board 28, and contact piece 27 is fixed to the underside of movable body 26. Contact portion 27A makes and breaks contact with fixed contact 28A confronting below. In other words, movable body 26 is disposed closer to operating body 21 than wiring board 28, and contact portion 27A of contact piece 27 extends in the direction away from operating body 21.

In the structure shown in FIG. 5, on the other hand, wiring board 38 is disposed under support portion 34A of case 34, and movable body 36 equipped with contact piece 37 is disposed between bottom cover 42 and wiring board 38. That is, wiring board 38 is disposed closer to operating body 21 than movable body 36, and contact portion 37A of contact piece 37 extends toward operating body 21.

Retaining ledges 33F of retaining portions 33G contact with the lower end of support portion 34A through which shaft portion 33B of rotary body 33 is inserted. The interior sides of retaining portions 33G contact with stopper faces 36C inside retaining holes 36B, so that stopper faces 36C prevent retaining portions 33G from deforming inward. Retaining portions 33G are fixed securely with respect to the lower end of support portion 34A by movable body 36.

In this structure, contact portion 37A of contact piece 37 fixed to the upper surface of movable body 36 makes elastic contact with one of fixed contacts (not shown) formed on the underside surface of wiring board 38. Movable body 36 rotates along with rotary body 33 by rotating operation of operating knob 21A, thereby causing contact piece 37 to make and break electrical contact with the confronting fixed contacts. As described, the switching unit is so constructed as to make and break electrical continuity when rotary body 23 is rotated by rotating operation of operating body 21. In other words, this switching unit has movable body 36, contact piece 37 and wiring board 38.

The switching unit needs not be limited to the structures of FIG. 1 and FIG. 5. The switching unit is only required to make and break the electrical continuity when rotary body 23 is rotated by rotating operation of operating body 21. For instance, the switching unit can be a package-type rotary encoder mounted to a wiring board so that it can make and break electrical continuity of internal contacts with rotation of operating body 21.

The embodiment is not limited to the case 24. For example, a dashboard or the like member in the vehicle where the switch is mounted may be used as a substitute of the case. Here, rotary body 23 may be supported rotatably by using a substrate or a circuit board provided with a support portion having a through hole, for instance, instead of the case.

As described above, a rotary switch of which the decorative cover can be attached easily to the operating body without using an adhesive can be achieved with a low production cost. This rotary switch is useful mainly for mounting into a front panel and an area in the proximity of steering wheel in a motor vehicle for operation of various electronic apparatuses.

What is claimed is:

1. A rotary switch comprising:

an operating body having a hollow operating knob, a hollow cylinder portion connected to the operating knob, and opened at one end opposite to the operating knob, and a locking portion extending from a side surface of the operating knob toward the cylinder portion, the locking portion being elastically deformable in an inside-to-outside direction of the operating knob within a space provided between a tip of the locking portion and the cylindrical portion;

a decorative cover having a cover portion, and a latching portion extending toward the operating body from a surface of the cover portion confronting the cylinder portion of the operating body;

a rotary body having a catching portion contacting with the locking portion, and disposed inside the cylinder portion of the operating body; and a switching unit configured to make and break electrical continuity as the rotary body is rotated by rotational operation of the operating body, wherein one of the latching portion and the locking portion is provided with a recess, and the other one is provided with a protrusion, and the decorative cover is attached to the operating knob by an engagement of the recess with the protrusion and the contact between the catching portion and the locking portion.

2. The rotary switch of claim 1, further comprising a case having an opening, wherein the operating knob of the operating body protrudes from the opening of the case, and the cylinder portion of the operating body is housed inside the case, and the rotary body is rotatably retained in the case.

3. The rotary switch of claim 2, wherein the rotary body has an upper cylinder portion disposed inside the cylinder portion of the operating body, and a shaft portion projecting from the upper cylinder portion toward an opposite side of the operating body, the shaft portion has a retaining ledge provided along an outer periphery at tip end side thereof, and a retaining portion formed at one side closer to the tip end than the retaining ledge, the retaining portion being elastically deformable in a radial direction of the shaft portion, the case has a support portion for rotatably supporting the shaft portion inserted therethrough, and the rotary switch further comprises a movable body having a retaining hole that holds the retaining portion of the shaft portion, and the movable body is attached to the shaft portion by having the retaining hole retain the retaining portion at one side of the support portion opposite to the operating body.

4. The rotary switch of claim 3, further comprising a restricting part fitted to the shaft portion of the rotary body at one end of the support portion closer to the operating body.

5. The rotary switch of claim 1, wherein the switching unit comprises:

a movable body attached to the rotary body at an opposite side to the operating body;

a contact piece fixed to the movable body, and having a contact portion extending outward from a surface opposite to another surface fixed to the movable body; and a wiring board having fixed contacts that confront the contact portion.

6. The rotary switch of claim 5, wherein the movable body is disposed closer to the operating body than the wiring board, and the contact portion of the contact piece extends in a direction away from the operating body.

7. The rotary switch of claim 5, wherein the wiring board is disposed closer to the operating body than the movable body, and the contact portion of the contact piece extends toward the operating body.

* * * * *